United States Patent [19]

Peterson

[11] Patent Number: 4,650,163

[45] Date of Patent: Mar. 17, 1987

[54] HYDRAULIC WINCH

[75] Inventor: Robert L. Peterson, Beaverton, Oreg.

[73] Assignee: Warn Industries, Inc., Bellevue, Wash.

[21] Appl. No.: 782,018

[22] Filed: Sep. 30, 1985

[51] Int. Cl.[4] ..... B66D 1/08; B66D 1/36

[52] U.S. Cl. ..... 254/327; 254/328; 254/361

[58] Field of Search ..... 254/323, 325, 327, 328, 254/361

[56] References Cited

U.S. PATENT DOCUMENTS

| | | | |
|---|---|---|---|
| 2,959,396 | 11/1960 | Lawrence | 254/323 X |
| 3,739,928 | 6/1973 | Randall | 254/327 |
| 3,788,605 | 1/1974 | Johnson | 254/328 X |
| 4,331,323 | 5/1982 | Sekimori et al. | 254/323 |

FOREIGN PATENT DOCUMENTS

| | | | |
|---|---|---|---|
| 170090 | 6/1951 | Austria | 254/323 |
| 2516222 | 10/1976 | Fed. Rep. of Germany | 254/327 |
| 663188 | 12/1951 | United Kingdom | 254/327 |

*Primary Examiner*—Stuart S. Levy
*Assistant Examiner*—Joseph J. Hail, III
*Attorney, Agent, or Firm*—Robert L. Harrington

[57] ABSTRACT

A hydraulic actuated winch adapted to be manually mounted and dismounted from a three point hitch of a farm tractor. The winch is mounted on a specialized mounting member that is specifically designed to quickly mount onto the link connections of the three point hitch. Quick connections are provided on the hydraulic lines of the winch adapted to quick connect into the hydraulic power source of the tractor.

2 Claims, 2 Drawing Figures

HYDRAULIC WINCH

FIELD OF INVENTION

This invention relates to a combination including a tractor having a hydraulic power source and a hydraulic actuated three point hitch, a hydraulic driven portable winch, and mechanism for quickly mounting and dismounting the winch to the three point hitch of the tractor and for connecting and disconnecting the winch to the hydraulic power source of the tractor.

BACKGROUND OF THE INVENTION

Winches have been in common use for many years. In general, a long wire rope is attached at one end to a spool and the other end is fitted with a hook or other type of attachment. The hook is attached to an object that is to be moved and the spool is rotated to wind the rope onto the spool and thereby pull the object toward the spool.

Applications for the winch are numerous and the winches developed for these applications can be categorized in several respects. The present invention is directed specifically to a hydraulic actuated mobile winch, i.e. it is adapted for mounting onto a vehicle to be transported from place to place and maneuvered as required to control the direction of pull of the object. The hydraulic winches are capable of much greater pulling loads than are electric driven winches, a second broad category of powered mobile winches which are often mounted on road vehicles that do not provide a hydraulic power source and the application for which does not demand the higher pulling capabilities.

It is an object of the present invention to provide a hydraulic powered mobile winch that is adapted for rapid connect and disconnect to a vehicle, specifically a "farm" tractor. Tractors contemplated herein originated on the farm and were used first to hitch onto and pull a number of different farm implements. Later it was used also as a power source to drive various stationary units such as pumps, grain elevators and the like. Hydraulic power was added to the tractor and its use expanded into "yard" use and can be now found at construction sites, golf courses and so on.

A significant development to the "farm" tractor in recent years is the hydraulic actuated three point hitch. Prior to the three point hitch, implements mounted to the tractor were of three general types, those implements that were adapted to be supported on the ground and pulled by the tractor, those elements that were adapted to be semi-permanently attached to the tractor (e.g. a fork lift) and those elements that were adapted to be hooked up to the tractors power source with the tractor in a stationary position (e.g. a grain elevator driven by the tractor's "power take off"). The three point hitch provides the advantage of rapid connection to a variety of formerly "pulled" field working implements (such as a plow) whereby the three points of connection coupled with hydraulic actuated lifting and lowering capabilities, allow the tractor to simply hitch onto the implement, pick it up, carry it to the field, and lower to a working height, all without the necessity of providing an undercarriage for the implement.

BRIEF DESCRIPTION OF THE INVENTION

The present invention was developed from a recognition that the three point hitch of a modern farm tractor can be adapted to carry a hydraulic winch, and that the hydraulics that actuate the hitch can be used to provide hydraulic power to the winch. The tractor is mobile and can easily maneuver the winch into position for directed pulling of the object, and because it is designed for quick connection, it offers the opportunity of a removable winch that can be rapidly attached to the tractor when needed and removed and stored out of the way when not needed. Accordingly, the present invention provides a mounting member that is fixed to the winch and is specifically designed to quickly connect to the three point hitch of the tractor. The hydraulic lines of the winch and tractor are provided with quick connect fittings whereby they can be rapidly connected and disconnected. The assembly constituting the winch and mounting member is further designed for light weight manual handling when combined with the excessability of the lowered hitch mechanism to enable a single person to handle the connect and disconnect operations.

These and other advantages will be apparent upon reference to the following detailed description of the preferred embodiment, having reference to the accompanying drawings wherein.

Figure 1:
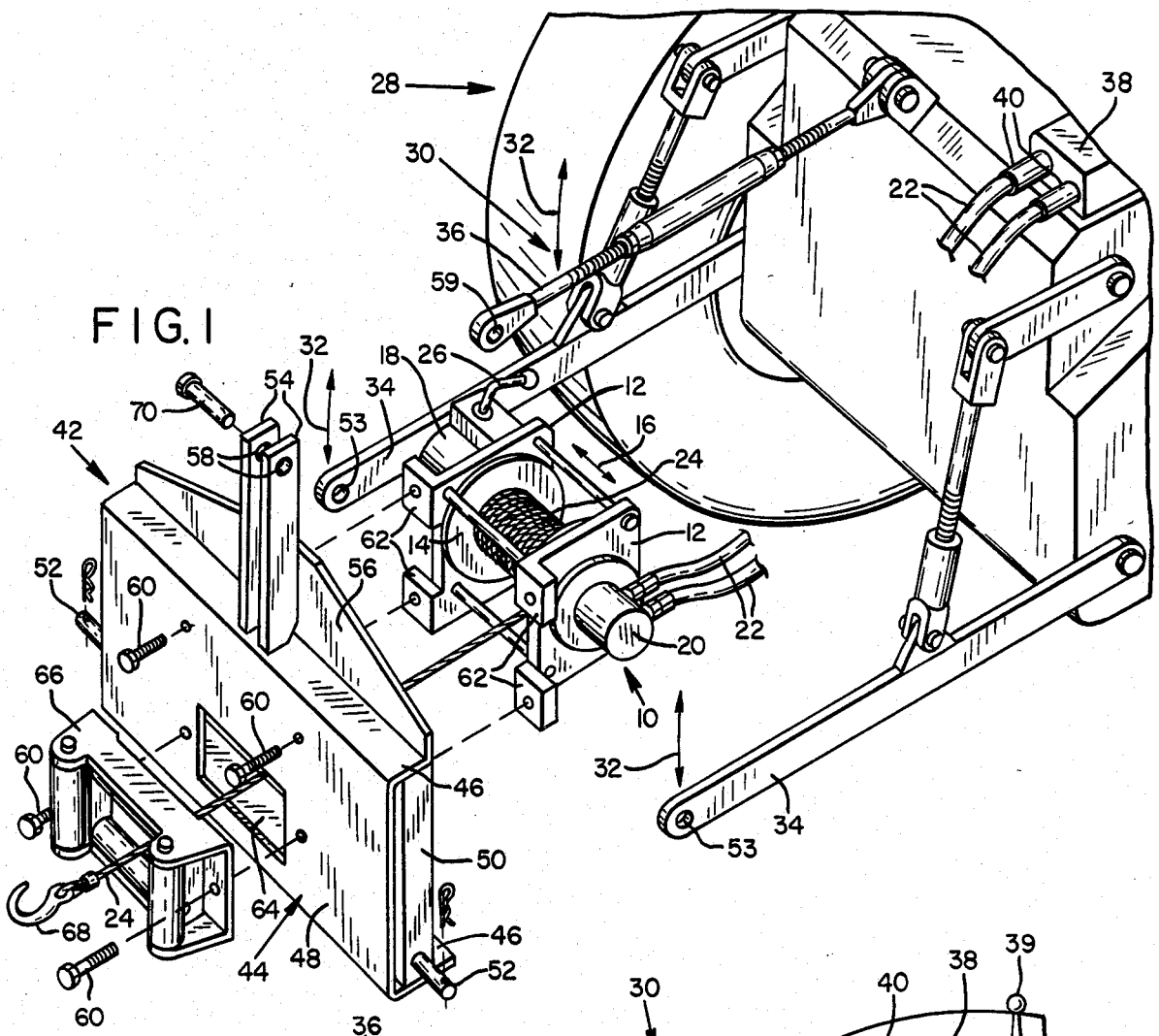
FIG. 1 is a perspective view illustrating the tractor, winch and mounting components of the invention in an exploded view relationship.

Reference is made to the drawings wherein FIG. 1 illustrates a winch 10 including a housing 12, a spool 14 carried by the housing and adapted to be rotatably driven relative to the housing as indicated by arrows 16 a gear train, the components of which are contained in housing end 18, a hydraulic motor, the components of which are contained in the housing end 20, and interconnect lines 22 for directing pressurized hydraulic fluid to the hydraulic motor. A wire rope 24 is wound onto the spool 14 and attached to its inner end to the spool to be wound and unwound therefrom upon rotation of the spool, as indicated by arrows 16. The rotation of the spool is powered by the hydraulic motor through a lever control generally indicated by reference number 39 at the power source. However, the spool can be disconnected from the gear train by lever 26 for easy unwinding of the wire rope.

Hydraulic winches of the above description are presently available on the market. It is preferred that the winch be of the planetary gear type, primarily because such winches are smaller in size and thus are ore easily handled and will fit between the laterally spaced links of the three point hitch to be desribed hereafter. Whereas such winches are not new to this invention, in the past such winches have been permanently mounted onto a truck bed or otherwise in fixed relation to a hydraulic power source, and accordingly in permanent readiness at a work station.

FIG. 1 illustrates a "farm" tractor 28 having a conventional three point hitch 30 i.e. laterally spaced connecting links 34 and an upper middle connecting link 36 are carried by the tractor and adapted for vertical pivoting as indicated by arrows 32. Vertical pivoting or raising and lowering of the extended ends of links 34 (arrows 32) is powered by a hydraulic power source provided by the tractor. The power source is generally indicated by reference number 38. Whereas this three point hitch is intended for a wide variety of implements, a standard has been established for the hitch design and that portion of the implement to be attached to it. See SAE Standards, SAE J909 APR80 and SAE J715 MAY80. The single modification to this tractor for the purposes of the present invention is the provision of the quick connect attachment 40 into the power source 38 adapted to accommodate the connecting hoses or lines 22.

Reference is now made to the mounting member 42. It is desirable that the plate-like mounting member 42 be strong i.e. so as not to buckle under the forces generated by the winch, and yet sufficiently light so that, in combination with the weight of the winch 10, it can be manually maneuvered onto and off of the three point hitch 30.

A plate 44 is formed into a strengthening channel configuration having upper and lower flanges 46 and a center web 48. Post members 50 span the flanges 46 to provide a rigid base structure that essentially maximizes strength with a minimum of metal material. The width of the plate 44 and the positioning of the posts 50 are such as to enable secure attachment (as by welding) of pins 52 to the post 50 in compliance with the SAE Standards for quick fastening of the pins to links 34. A pair of brackets 54 are attached in an upright position to the upper flange 46 (as by welding) as illustrated, and a support member 56 formed as an extension of upper flange 46, supports the upright brackets 54. Holes 58 in the brackets 54 are provided for fastening of the brackets to the upper link 36 in accordance with SAE Standards.

Figure 2:
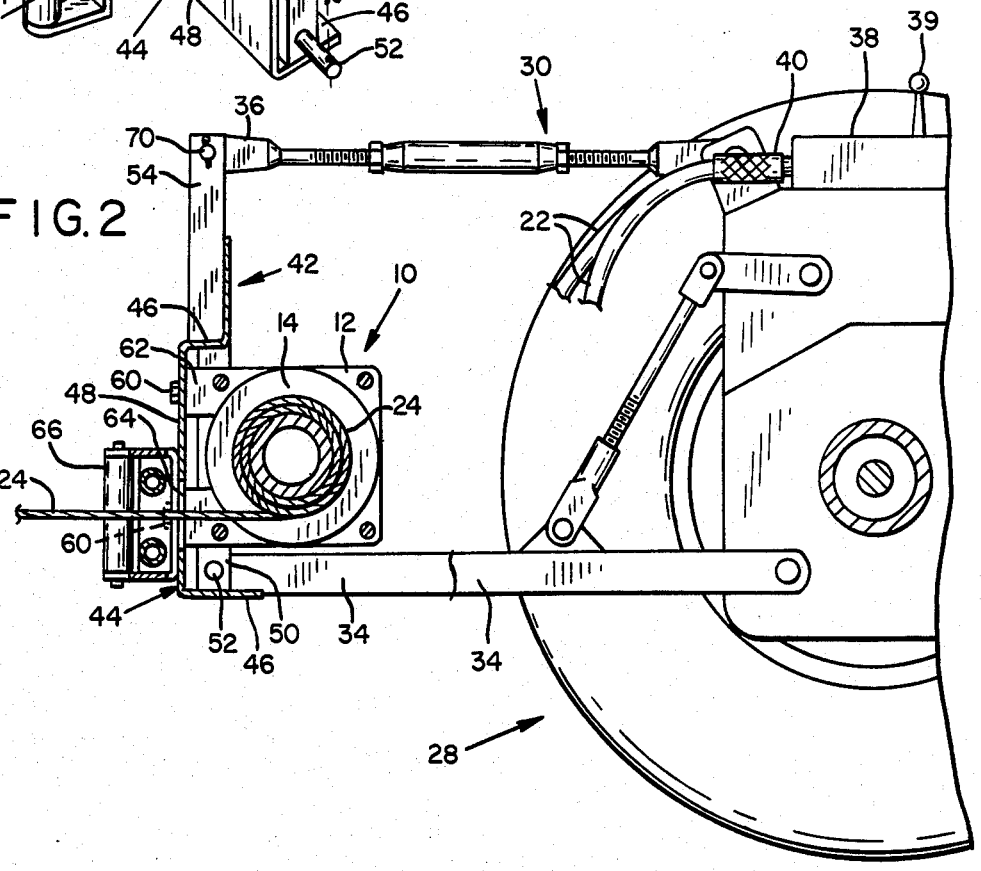
FIG. 2 is a side view of the components of FIG. 1 but in the assembled condition.

Reference is now made to FIG. 2 as well as FIG. 1. As will be apparent, the winch 10 is adapted to mount onto the tractor side of the mounting member 42. As illustrated, bolts 60 are projected through holes in the web 48 and then through the bolt receiving holes in legs 62 of the winch housing 12. Nuts (not illustrated) are screwed onto the bolt ends to secure these components together. The wire rope 24 of the winch 10 projects through an opening 64 in the web 44 rearwardly from the tractor 28. Whereas the tractor 28 is desirably situated to provide for pulling of an object in line with the winch 10, the opening 64, and the longitudinal axis of the tractor, very frequently such alignment is not feasible. To accommodate misalignment, roller assembly 66 (mounted to the plate 44 with the lower two of bolts 60) provide rollers above, below and to the sides of the opening 64 as a bearing for the taut rope when pulling at an angle.

OPERATION

It will be appreciated that there are many occasions where the use of a winch is highly desirable. Many of the occasions require maneuvering of the winch into a "working" position and frequently where the pulling power demands a winch capability greater than that available from an electric winch. A solution to this need is the provision of this invention whereby a conventional hydraulic winch can be mounted onto an available "farm" tractor. Whereas the farm tractor is designed to accommodate many different types of working implements, the device of the present invention satisfies that design by providing the mounting means for quickly and easily mounting and dismounting the winch to the three point hitch of the tractor. The only modification required is the provision of hydraulic line interconnections with the hydraulic power source. A key element, however, is the provision of the mounting member integrated with the winch, which member is adapted specifically to accommodate the quick connect capabilities of the three point hitch.

Thus the winch with mounting member attached can be stored until there is a need for that implement. Its weight and size allows manual handling and rapid mounting to the hitch (which is assisted by a lowering of the hitch to ground level). With the hydraulic lines 22 connected to the power source 38, the tractor is ready to be maneuvered into place. The hook 68 on the end of the rope 24 is used to engage an object, and by operation of the lever 39, the rope is wound onto the spool to forcably pull the object toward the tractor. Note here also that the force acting on the winch 10 is a compressing force, thus minimizing the requirements of the fasteners 60 for holding the winch to the member 42.

Whereas mounting the member 42 to the three point hitch is dictated by SAE Standards, it will be readily apparent that attachment of the member to the hitch simply requires sliding the pins 52 through openings 53 in the links 34, (then securing them with cotter keys), and positioning link 36 between brackets 54 to align holes 58 with hole 59 and inserting a pin 70 through the aligned holes. Also, quick connect fasteners for hoses are common, and it is sufficient for this disclosure that reference simply be made to their utilization for interconnecting the lines of the winch to the tractor's hydraulic power source. Those skilled in the art will be well aware of the hardware and the requirements for tapping into the hydraulic power source.

Modifications to the disclosure herein will be apparent to those skilled in the art without departing from the invention and accordingly the scope of the invention is determined by the claims appended hereto.

I claim:

1. A combination winch-tractor assembly having rapid connect and disconnect capabilities comprising; a conventional farm type tractor having a hydraulic power source and a conventional three point hitch having three fastening elements provided on the ends of three rearwardly projected arms, said fastening elements having fastening points that in combination define a generally vertical plane, said hitch actuated by the hydraulic power source for raising and lowering the arms and thereby implements fastened to the hitch;

a hydraulic winch having a housing, a spool rotatably mounted in the housing, a hydraulic motor for rotatably driving the spool relative to the housing, a wire rope attached at one end to the spool for winding and unwinding the wire rope by rotation of the spool and including a fastening means on the free end for attaching said free end to objects, and mounting means carried by said housing for securely mounting said winch to a support;

said support for the winch comprised of a plate-like support, member generally defining a plane, three fastening elements fixed to the support member in spaced relationship, and in the general plane defined by the plate-like member, said fastening elements aligned with and adapted for rapid connection and disconnection to the three fastening elements of the three point hitch of the tractor thereby to mount the plate-like member in a verticle position parallel to and substantially in line with the plane of the three fastening elements of the three point hitch, and mounting means on the plate-like support member confined within an area defined by the fastening elements, said mounting means compatible with the mounting means carried by the winch for securely and rigidly mounting the winch to the plate-like support in said defined area, said winch positioned on the tractor side of the plate-like member to thereby, when operated, generate a generally axial pull on the arms of the hitch and a compressive force against the plate;

and hydraulic lines for interconnecting the hydraulic motor of the winch to the hydraulic power source of the tractor and including quick connect fasteners for rapid connection and disconnection of the motor and power source.

2. A combination winch-tractor assembly as defined in claim 1 wherein bearing elements are provided on the outer side of the support member above, below and at each side of the opening therethrough to slidably support the wire rope when pulling an object at an angle relative to a directional line that is normal to the plane of the plate-like support.

* * * * *